US007770968B2

(12) United States Patent
Bartlmae

(10) Patent No.: US 7,770,968 B2
(45) Date of Patent: Aug. 10, 2010

(54) STACKABLE CHAIR

(76) Inventor: Kerstin Bartlmae, Via Simone Stefani 20B, 1-16038 S. Margherita Lig. (GE) (IT)

( * ) Notice: Subject to any disclaimer, the term of this patent is extended or adjusted under 35 U.S.C. 154(b) by 16 days.

(21) Appl. No.: 12/117,254

(22) Filed: May 8, 2008

(65) Prior Publication Data

US 2008/0277982 A1 Nov. 13, 2008

Related U.S. Application Data

(60) Provisional application No. 60/916,982, filed on May 9, 2007.

(51) Int. Cl.
*A47C 3/04* (2006.01)
*A47C 1/12* (2006.01)

(52) U.S. Cl. ..... 297/239; 297/248; 297/451.1; 297/448.1

(58) Field of Classification Search ..... 297/239, 297/248, 451.1, 448.1
See application file for complete search history.

(56) References Cited

U.S. PATENT DOCUMENTS

| | | | | | |
|---|---|---|---|---|---|
| D169,930 | S | | 6/1953 | Chapman et al. | |
| 3,159,428 | A | | 12/1964 | Schier | |
| D200,532 | S | | 3/1965 | Williams | |
| 3,224,810 | A | * | 12/1965 | Jenniges et al. | 297/451.1 |
| 3,278,227 | A | * | 10/1966 | Rowland | 297/239 |
| 3,291,529 | A | | 12/1966 | Straits | |
| 3,328,075 | A | * | 6/1967 | Albinson | 297/239 |
| 3,403,882 | A | | 10/1968 | Lindqvist | |
| 3,610,686 | A | * | 10/1971 | Caruso | 297/239 |
| 3,677,601 | A | * | 7/1972 | Morrison et al. | 297/440.11 |
| 3,755,853 | A | * | 9/1973 | Barile | 16/42 R |
| D228,989 | S | | 11/1973 | Furey | |
| 3,982,785 | A | * | 9/1976 | Ambasz | 297/160 |
| 4,084,850 | A | * | 4/1978 | Ambasz | 297/317 |
| 5,626,394 | A | * | 5/1997 | Perry | 297/448.2 |
| D381,828 | S | | 8/1997 | Kemnitzer | |

(Continued)

OTHER PUBLICATIONS

Product information from Hiller website, pp. 1-4, (believed to have been offered for sale, publicly used, and/or published prior to the filing date of this application).

(Continued)

*Primary Examiner*—David Dunn
*Assistant Examiner*—Tania Abraham
(74) *Attorney, Agent, or Firm*—Gifford, Krass, Sprinkle, Anderson & Citkowski, P.C.; Douglas L. Wathen

(57) ABSTRACT

A stacking chair having a seat, a back support, and a frame for supporting the seat and back support. The frame includes a pair of spaced apart leg members, a back support member, and a seat support member. The leg members have a front portion and rear portion interconnected by a connecting portion to give the leg members a generally U or V shape. The chair further includes a stacking member disposed on each leg member. The stacking member shaped to receive the upper surface of a leg member of a like chair such that the stacking member rests on the connection portion of a like chair and the upper chair in the stack is positioned forward of the lower chair thereby offsetting the stack's tendency to lean back due to the weight and position of the back support thus providing for the stability of a stack of chairs.

11 Claims, 5 Drawing Sheets

U.S. PATENT DOCUMENTS

| | | | | |
|---|---|---|---|---|
| 5,863,096 | A * | 1/1999 | Bartlmae | 297/248 |
| 5,868,468 | A * | 2/1999 | Wang | 297/320 |
| D413,029 | S | 8/1999 | Caruso | |
| D414,620 | S | 10/1999 | Kabadayan | |
| D457,744 | S | 5/2002 | Lewis | |
| D469,621 | S | 2/2003 | Kita et al. | |
| 6,517,162 | B2 * | 2/2003 | Cheng | 297/440.14 |
| D486,317 | S | 2/2004 | Roth et al. | |
| D497,729 | S | 11/2004 | Peitz et al. | |
| 6,820,934 | B2 * | 11/2004 | Ware et al. | 297/285 |
| 6,860,556 | B2 | 3/2005 | Barile, Sr. et al. | |
| 6,866,338 | B2 * | 3/2005 | Mendenhall et al. | 297/239 |
| D513,456 | S | 1/2006 | Smith | |
| D515,330 | S | 2/2006 | Lucci et al. | |
| D520,768 | S | 5/2006 | Glass et al. | |
| D541,069 | S | 4/2007 | Peitz et al. | |
| D542,553 | S | 5/2007 | Peitz et al. | |
| D544,228 | S | 6/2007 | Bartlmae at al. | |
| D544,229 | S | 6/2007 | Bartlmae at al. | |
| D544,236 | S | 6/2007 | Swy et al. | |
| 2005/0146178 | A1 | 7/2005 | Hergesell et al. | |

OTHER PUBLICATIONS

Picture of stacked chair (believed to have been offered for sale, publicly used, and/or published prior to the filing date of this application).

* cited by examiner

STACKABLE CHAIR

CROSS REFERENCE TO RELATED APPLICATION

This application claims the benefit of U.S. provisional patent application Ser. No. 60/916,982 filed May 9, 2007.

BACKGROUND OF THE INVENTION

1. Field of the Invention

The present invention relates generally to a stacking chair having a stacking member that helps stabilize the stacking of like chairs atop one another.

2. Description of the Prior Art

A stacking chair typically includes a horizontal seat, a back support, and a frame for supporting the seat and back support. The frame typically includes a pair of spaced apart leg members, a seat support member for supporting the seat and a back support member for supporting the back support. As the stacking chairs are placed atop each other, the weight and position of the back support of the chairs may cause the stack to lean towards the direction of the back supports (backwards) and thus collapse. Attempts to correct the tendency of a stack to lean backwards has resulted in over-compensation and thus as a stack grows higher with each chair, the over-compensated stack of chairs tend to lean forward and become unstable. Accordingly, it is desirable to have a stacking chair whereby each chair in the stack is properly aligned to the other to create stable stack.

SUMMARY OF THE INVENTION

A stacking chair having a seat, a back support, and a frame for supporting the seat and back support. The frame includes a pair of spaced apart leg members, a back support member, and a seat support member. Each of the pair of spaced apart leg members has a front leg portion and a rear leg portion, and a connection portion connecting the rear leg portion to the front leg portion. A seat support member extends between the pair of leg members and supports the seat. The connection portions of the leg members are connected to the seat support member. The stacking chair further includes a stacking member disposed on each of the pair of leg members. The stacking member is shaped to receive the connection portion of a like chair such that the stacking member rests on the connection portion of a like chair and the upper chair in a stack of chairs is positioned slightly forward of the lower chair a predetermined distance thereby offsetting the stacks tendency to lean back due to the weight and position of the back support while at the same time preventing the stack from leaning forward and thus providing for the stability of a stack of chairs.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
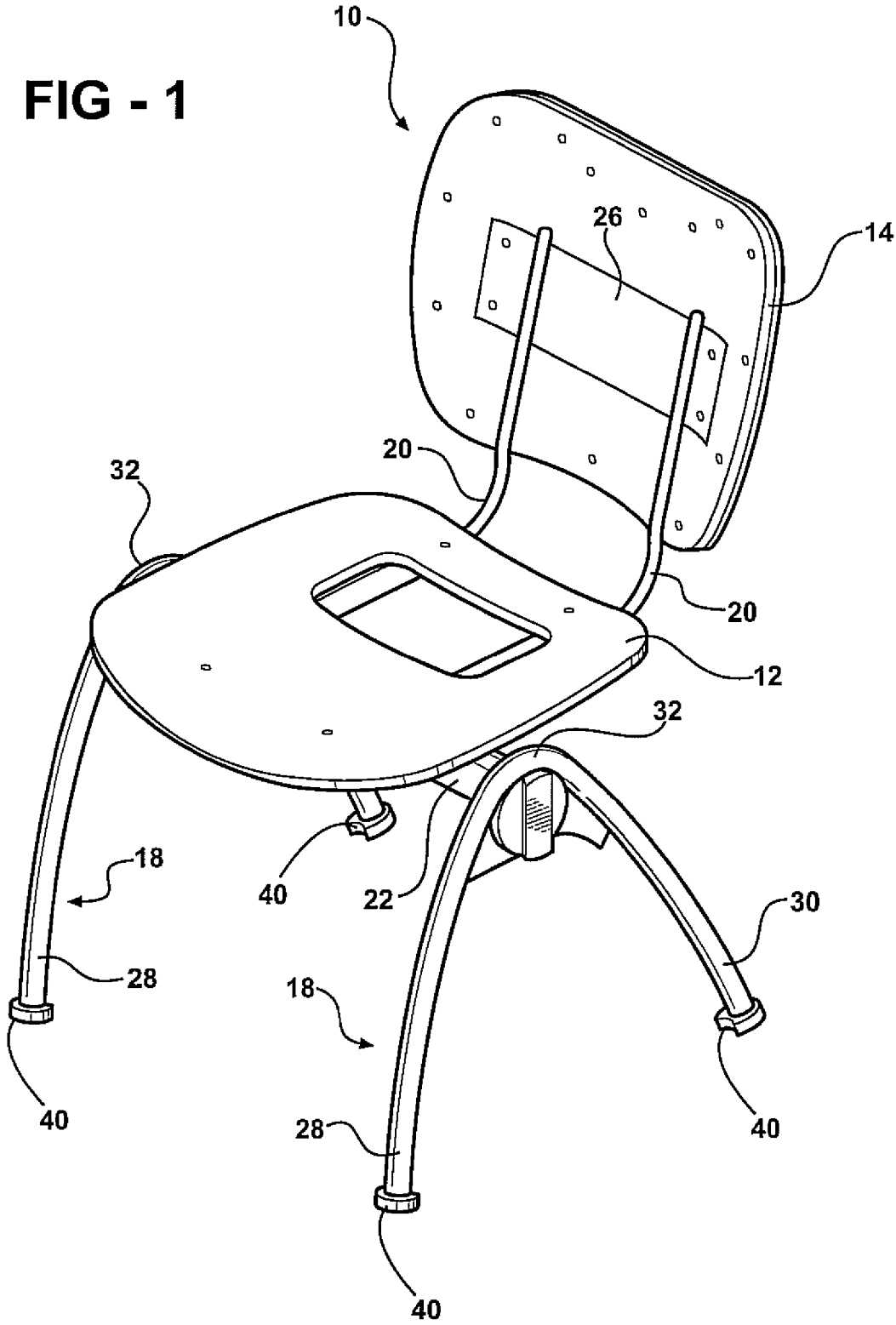
FIG. 1 is a perspective view of a stacking chair according to an embodiment of the present invention.
Figure 2:
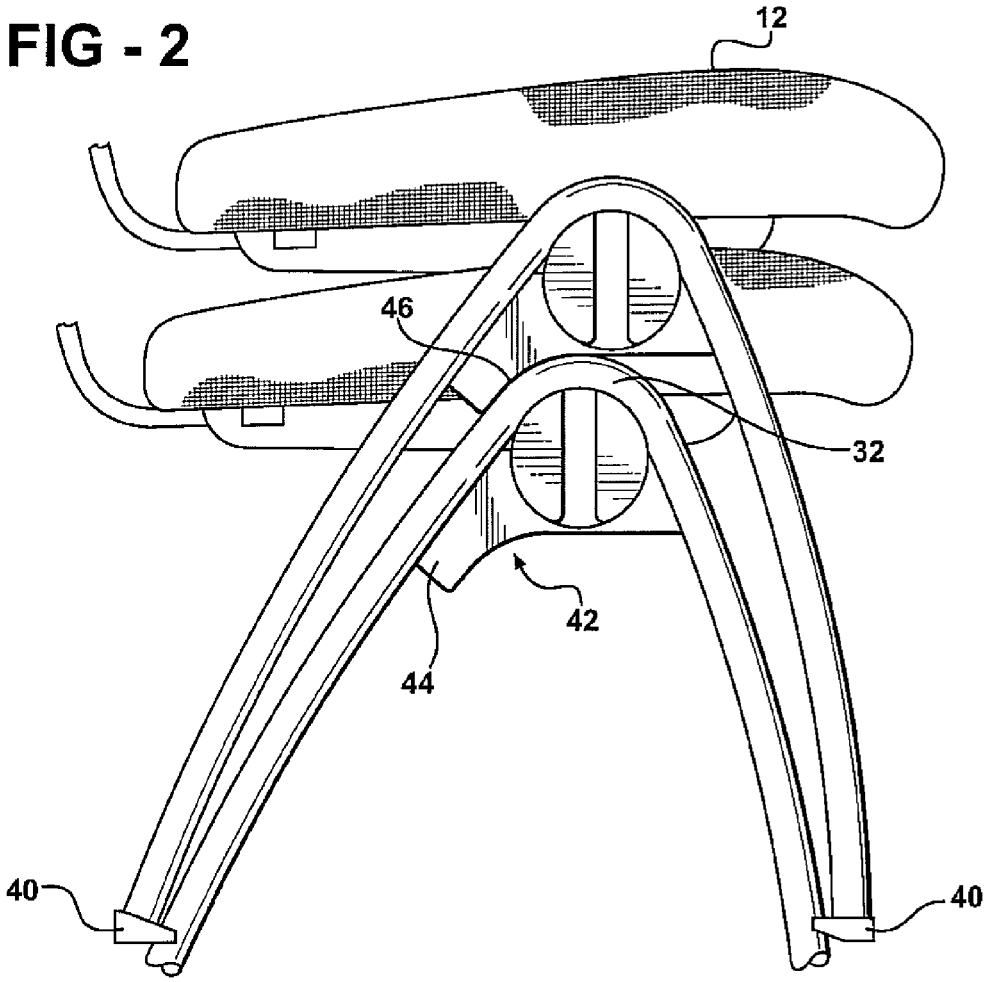
FIG. 2 provides a perspective view of chairs similar to the chair of FIG. 1 arranged into a stack, as well as a view of a floor glide that acts as a stacking assist.

Referring to the Figures, wherein like numerals indicate corresponding parts throughout the several views, a stacking chair 10 is provided: FIG. 1 illustrates a stacking chair 10 according to an embodiment of the present invention. The stacking chair 10 is designed such that multiple chairs of the same likeness may be stacked one atop another for storage or transportation, as shown in FIG. 2. Additionally, the chair is equipped with features which allow for the chairs to be interconnected with similarly equipped chairs in a side-by-side relationship. The stacking chair 10 includes a seat 12, a back support 14, and a frame 16.

Figure 3B:
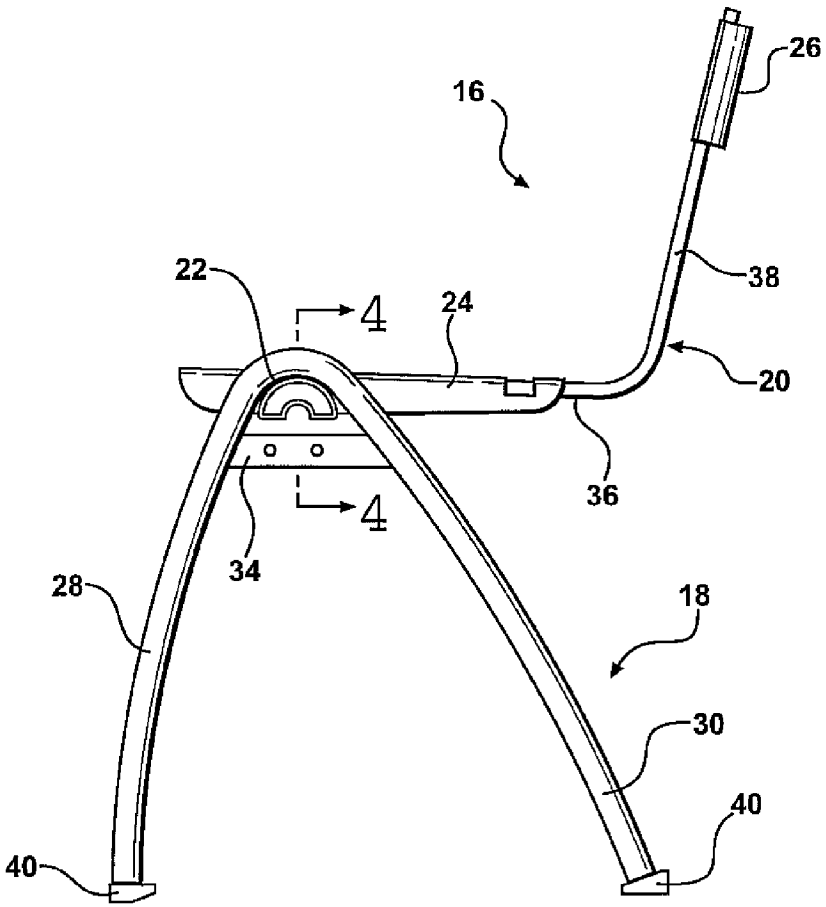
FIGS. 3*a* and 3*b* are top and side views of a frame of the chair of FIG. 1.
Figure 3A:
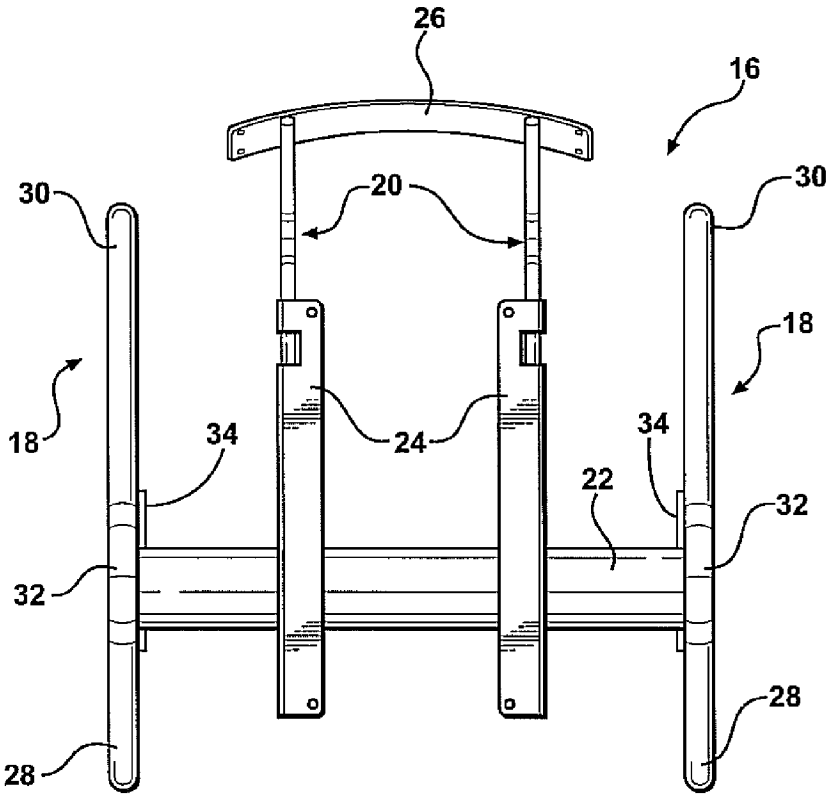

With reference now to FIGS. 3*a* and 3*b*, the frame 16 includes a pair of leg members 18, a back support member 20, and a seat support member 22. Each leg member 18 generally has the shape of an inverted U or inverted V and is symmetric to the other. The leg members 18 and are shaped such that the leg members 18 of an upper chair of the same likeness may rest on and be supported by the leg members 18 of a lower chair of the same likeness. The frame 16 may include additional elements such as a pair of seat support brackets 24, and back support brackets 26. As shown in FIG. 3*a* the frame 16 may be interconnected with these brackets 24, 26.

The leg members 18 are similar, so a detailed description of one leg fully describes the other. Each leg member 18 may be said to have a front leg portion 28 and a rear leg portion 30 interconnected at their upper end by a connecting portion 32. The connecting portion 32 has a curve to provide the leg member 18 with the inverted U or V shape. The seat support member 22 extends between the connecting portion 32 of each leg member 18 to provide support for the seat 12. Seat support brackets 24 are attached to the frame 16 to provide additional support for the seat 12. Preferably, the pair of seat support brackets 24 is spaced apart from each other and each are attached to the seat support member 22 such that the seat support brackets 24 are orthogonal thereto and provide a platform for supporting the seat 12. Thus the seat support brackets 24 may be used to help provide further stability to the frame 16 giving the chair better stability.

In the preferred embodiment, the seat support member 22 is a hollow tube having a convex upper surface and a concave lower surface to provide the seat support member 22 with a C-shaped profile. This shape provides the support member with strength and rigidity and further increases the strength and stiffness of the frame 16. With reference again to FIGS. 3*a* and 3*b*, one end of the seat support member 22 is attached to the connecting portion 32 and/or upper ends of the leg portions 28, 30 of the leg member 18 and the other end of the seat support member 22 is attached to the connecting portion 32 and/or upper ends of the front and rear leg portions 28, of the other leg member 18. Preferably, the convex upper surface of the seat support member 22 is welded to the underside of each connecting portion 32 of each leg member 18. Thus the seat support member 22 of the preferred embodiment provides support for the seat 12 which is generally horizontal.

Figure 4:
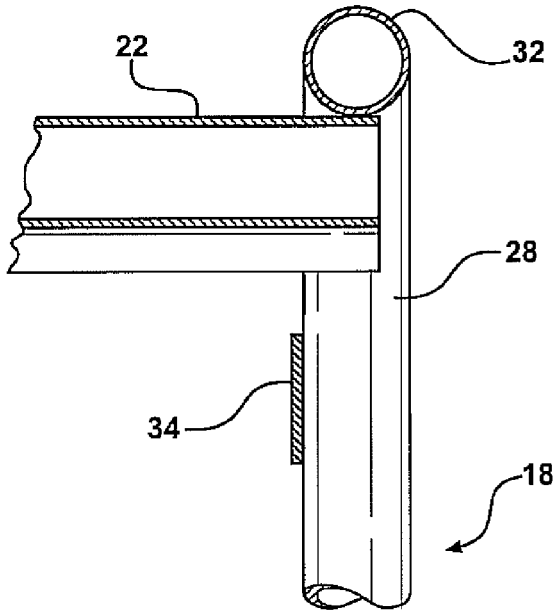
FIG. 4 is a cross sectional view of FIG. 3*b* taken along lines 4-4.

With reference again to FIG. 3*b*, embodiments of the present invention also preferably include a leg reinforcement member 34 that extends between the front and rear leg portions 28, 30 just below the seat support member 22. The disposition of reinforcement member on the stackable chair is also illustrated in the cross-sectional view of FIG. 4. As shown, it is preferably attached to the inner side of the leg member 18. A corresponding leg reinforcement member 34 is attached to the inner side of the other leg member 18. The leg reinforcement members 34 help to resist spreading of the front and rear leg portions 28, 30 away from each other when loaded or stacked. The C-shaped profile of the seat support member 22 and the high positioning of the reinforcement member help to reduce the stacking height of a stack of chairs.

The back support member 20 is provided to attach the back support 14 to the chair. The back support member 20 interconnects the back support 14 with the seat 12 and/or seat support member 22. In a preferred embodiment, the back support member 20 is a pair of L-shaped bars and back support brackets 26 are used. Each of the pair of L shaped bars has a first portion 36 generally orthogonal to a second portion 38. As shown in FIG. 3*b* the first portions 36 are attached to the seat support bracket 24 and the second portions 38 are attached to the back support 14. The pair of back support brackets 26 adds further stability and comfort for the user. The pair of back support brackets 26 extends between the second portion 38 of each of the pair of back support members 20. Thus the back support member 20 and back support brackets 26 add further comfort and support for a user's back. The chair in FIG. 1 is illustrated without upholstery, though it is preferred that the seat 12 and back support 14 are covered with upholstery.

With reference again to FIG. 1, glides 40 are provided to prevent the leg members 18 from scratching the surface of a floor, and to help align the stacking chairs 10 in a stacked position. The glides 40 are disposed on the front leg portion 28 and the rear leg portion 30 of each of the pair of leg members 18. The glide 40 has a concave face and is positioned on each rear and front leg portion 30, 28 such that the concave face of the rear leg portion 30 faces the concave face of the front leg portion 28. The glides 40 help align the stacking chairs 10 when stacked on top of each other by guiding the pair of leg members 18 of an upper chair onto the pair of leg members 18 of a lower chair. Specifically, the concave face engages the outer face of the front and rear leg portions 28, 30 of a lower chair when a like chair with the glide 40 is stacked thereon. The glides 40 also help maintain the position of each stacking chair 10 in a stack with respect to the other to ensure that the stacked chairs are more stable and do not collapse. The glide 40 is preferably a polymer material that allows the chair to be moved without scratching a flooring surface.

Figure 5:
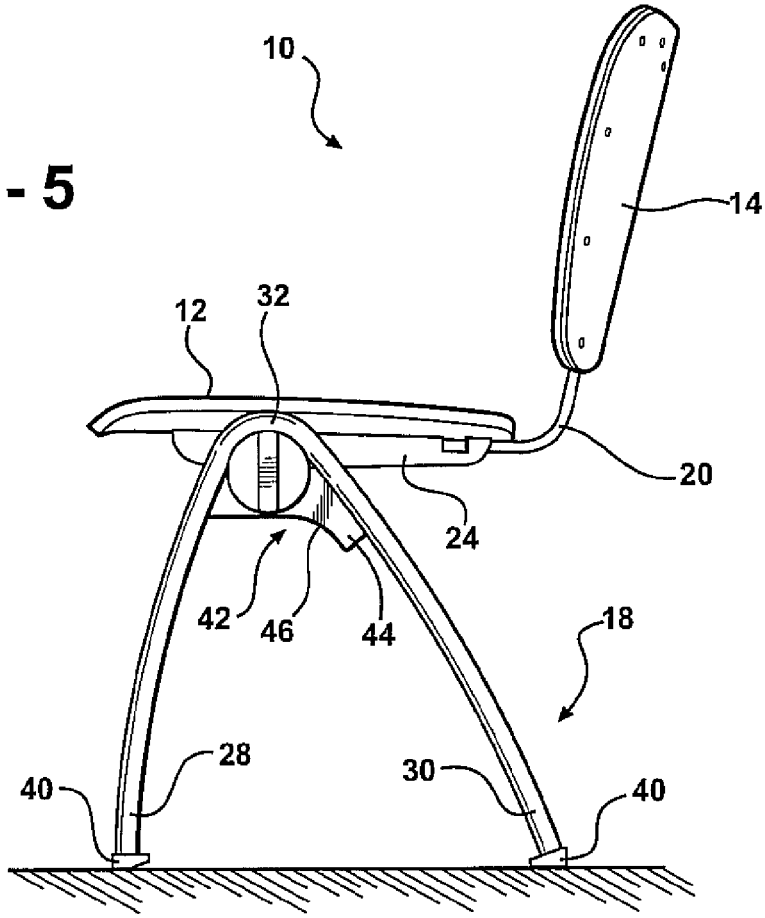
FIG. 5 is a side view of the chair of FIG. 1 showing the stacking member.

Referring again to FIGS. 1 and 5, chairs according to the present invention preferably also include stacking members 42. The stacking members 42 are disposed on each of the pair of leg members 18, and include a wing 44 extending from the seat support member 22 to the rear leg portion 30. The wing 44 has a curved receiving surface 46 shaped to receive the connection portion of a like chair such that the stacking member 42 rests on the connection portion of a like chair. The wing 44 positions the upper chair on the lower chair such that the upper chair is forward of the lower chair a predetermined distance thereby centering the stacking chair in a stack of like chairs. Thus the stacking member eliminates the problem of stacking chairs 10 leaning back due to the weight and position of the back support 14, while at the same time preventing the stack from leaning forward as a result of compensating for the weight and position of the back support. The stacking member 42 cooperates with the glide 40 to maintain the position of each stacking chair 10 in a stack with respect to the other to help ensure that the stacked chairs do not collapse and to align the stacking chairs 10 when stacked on top of another. The stacking members 42 are preferably formed of a polymeric material.

Figure 6:
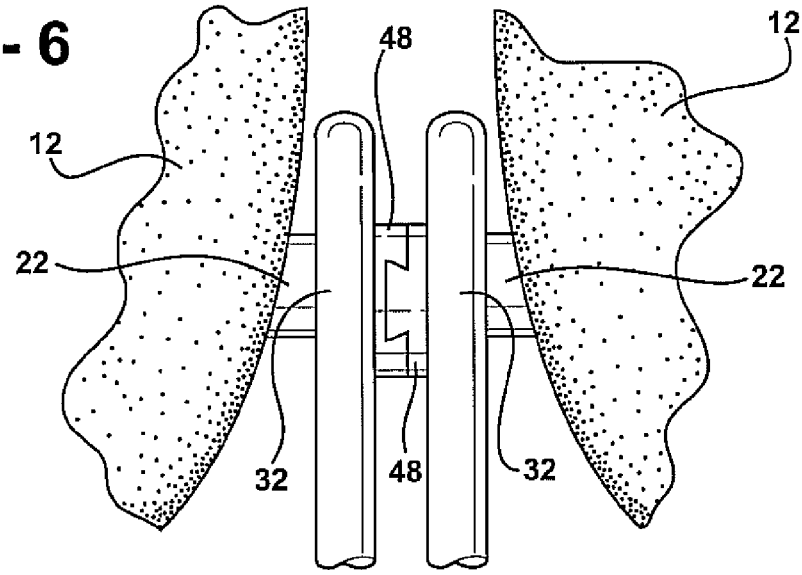
FIG. 6 is a view looking down at a pair of ganging devices interconnected with one another.
Figure 7:
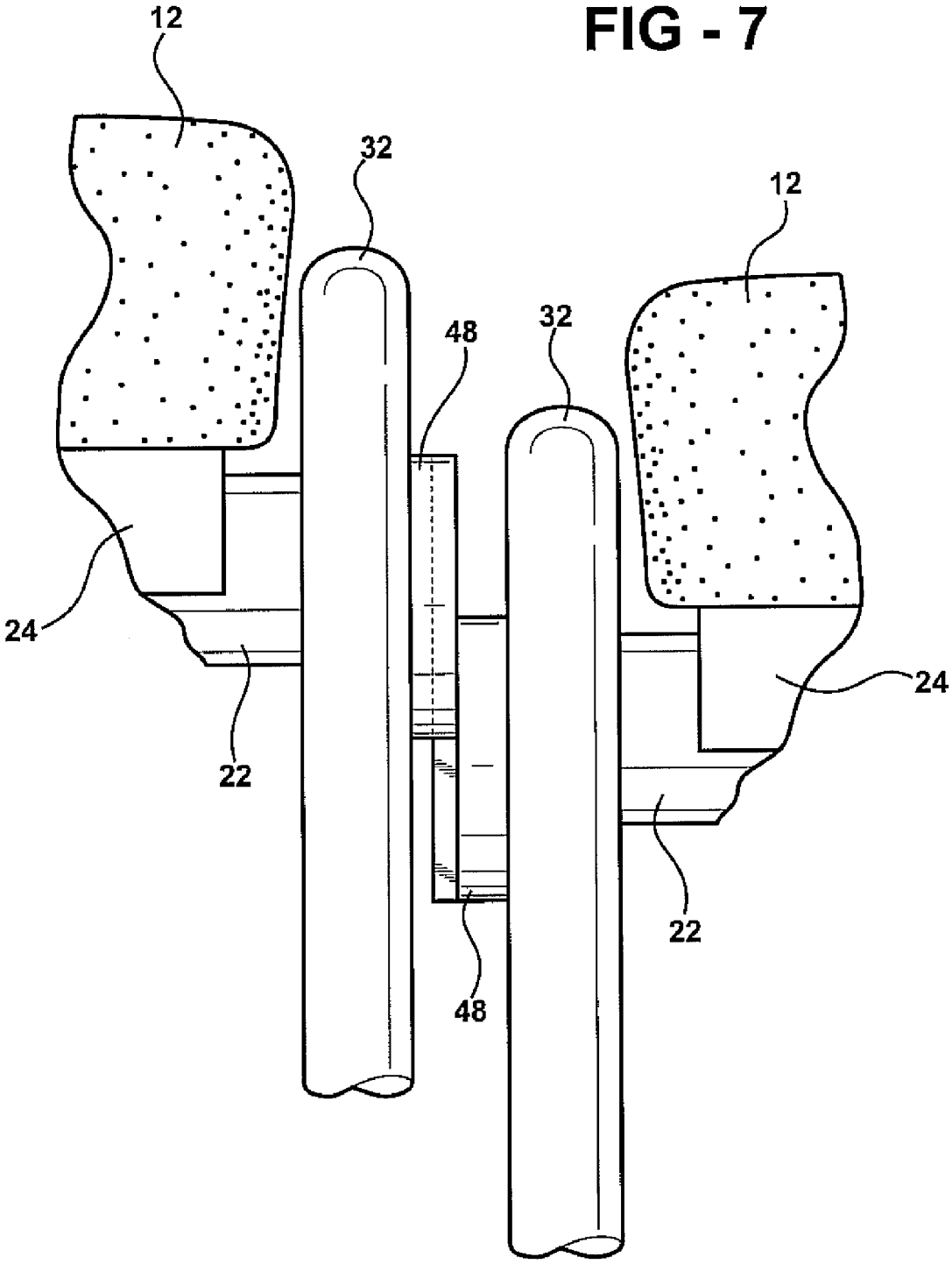
FIG. 7 is perspective of view of a pair of ganging devices showing the relationship between the male ganging device and the female ganging device engaged in an interlocking position.

Referring back to FIG. 1, a male ganging device 48 is shown interconnected with a side of the chair adjacent the connecting portion 32 of the leg member 18. A corresponding female ganging device 48 is provided on the other side of the chair, though not shown in FIG. 1. When two similar chairs are arranged side by side, the ganging device 48 of one chair may engage the corresponding ganging device 48 of the adjacent chair. FIGS. 6 and 7 are different perspective views of a pair of ganging devices 48 of FIG. 1 interconnected with one another. As will be clear to those of skill in the art, the ganging devices 48 may be interchanged, as long as the ganging devices 48 on corresponding chairs are also interchanged.

Obviously, many modifications and variations of the present invention are possible in light of the above teachings and may be practiced otherwise than as specifically described while within the scope of the appended claims. In addition, the reference numerals are merely for convenience and are not to be read in any way as limiting.

The invention claimed is:

1. A stacking chair comprising:

a seat;

a back support;

a frame including a pair of spaced apart leg members, a back support member, and a seat support member, wherein each of the pair of spaced apart leg members has a front leg portion and a rear leg portion, the frame supporting the seat and the back support;

a connection portion interconnecting the front leg portion to the rear leg portion, the connection portion being curved;

the seat support member extending transversely across the frame, the seat support member having a first end connected to the connection portion of one of the pair of leg members and an opposite second end connected to the connection portion of the other of the pair of leg members; and wherein the seat support member is a hollow tube having a convex upper surface and a concave lower surface to provide a C-shaped cross sectional profile to the seat support member, the hollow tube being generally straight and having a generally constant cross section, the connection portions of the leg members being directly connected to the convex upper surface of the tube; and a stacking member disposed on each of the pair of leg members, the stacking member shaped to receive the connection portion of a like chair such that the stacking member rests on the connection portion of a like chair thereby providing for the stacking of the stacking chairs on top of each other.

2. A stacking chair according to claim 1, wherein the stacking member includes a wing extending from the seat support member to the rear leg portion, the wing having a curved receiving surface shaped to receive the connection portion of a like chair.

3. A stacking chair according to claim 2, wherein the leg members are shaped like an inverted V.

4. A stacking chair according to claim 1 further including a glide disposed on the front leg portion and the rear leg portion of each of the pair of leg members, the glide having a concave face, the concave face of the glide the rear leg portion faces the concave face of glide on the front leg portion, the glides cooperating with the stacking member to align the stacking chairs when stacked on top of each other by guiding the pair of leg members onto the pair of leg members of a like chair and also maintaining the position of each stacking chair in a stack with respect to the other.

5. A stacking chair according to claim 1, further including a pair of corresponding ganging device attached at opposite ends of the seat support member.

6. A stacking chair according to claim 1 wherein the frame further includes a pair of seat brackets spaced apart from each other and are attached to the seat support member such that the seat brackets are orthogonal thereto to provide a platform for supporting the seat.

7. A stacking chair according to claim 6 wherein the back support member comprises a pair of L-shaped bars spaced apart from each other, each of the pair of L shaped bars having a first portion generally orthogonal to a second portion, the first portion being attached to the seat support brackets and the second portion being attached to the back support.

8. A stacking chair according to claim 7, further including a back support bracket extending between the second portion of each of the pair of L shaped bars.

9. A stacking chair according to claim 1 further including a leg reinforcement member extending between the front and rear leg portions of each leg member, the leg reinforcement member attached to the inner side of each of the leg members to help resist spreading of the front and rear leg portions away from each other.

10. A stacking chair according to claim 1, wherein each leg member comprises a continuous tubular member forming the front leg portion, the connection portion, and the rear leg portion.

11. A stacking chair comprising:

a horizontal seat;

a back support;

a frame including a pair of spaced apart leg members, a back support member, and a seat support member, wherein each of the pair of spaced apart leg members has a front leg portion and a rear leg portion, the frame supporting the seat and the back support;

a leg reinforcement member extending between the front and rear leg portions of each leg member, the leg reinforcement attached to the inner side of the leg member to help resist spreading of the front and rear leg portions away from each;

a pair of seat brackets spaced apart from each other and attached to the seat support member such that the seat brackets are orthogonal thereto to provide a platform for supporting the seat;

a back support member that interconnects the back support with the seat and/or seat support member; the back support member being a pair of L-shaped bars spaced apart from each other, each of the pair of L shaped bars having a first portion generally orthogonal to a second portion, the first portion being attached to one of the seat support brackets and the second portion being attached to the back support;

a back support bracket extending between the second portion of each of the pair of L shaped bars;

a connection portion interconnecting the front leg portion to the rear leg portion of the leg member, the connection portion being curved;

a pair of corresponding ganging devices attached at opposite ends of the seat support member, one of the pair of ganging devices having a male feature and the other of the pair of ganging devices having a female feature, the male and female features capable of interlocking with the corresponding ganging devices of a like chair, thereby providing for the interconnection of the stacking chairs in a side-by-side relationship;

a glide disposed on the front leg portion and the rear leg portion of each of the pair of leg members, each glide having a concave face, the concave face of the rear leg portion facing the concave face of the glide on the front leg portion, the glide helping align the placement of the stacking chairs on top of each other by guiding the pair of leg members onto the pair of legs of a like chair by having concave face of the glide registered to the pair of leg members of a like chair;

the seat support member defined by a hollow tube having a convex upper surface and a concave lower surface to provide a C-shaped cross sectional profile to the seat support member, the hollow tube being generally straight and having a generally constant cross section, the seat support member extending transversely across the frame, having a first end connected to the connection portion of one of the pair of leg members and an opposite second end connected to the connection portion of the other of the pair of leg members, wherein the connection portions of the leg members are connected to the convex upper surface of the tube; and a stacking member disposed on each of the pair of leg members, the stacking member including a wing extending from the seat support member to the rear leg portion, the wing having a curved receiving surface shaped to receive the connection portion of a like chair such that the stacking member rests on the connection portion of a like chair thereby providing for the stacking of the stacking chairs on top of each other, the stacking member cooperating with the glide to maintain the position of each stacking chair in a stack.

* * * * *

UNITED STATES PATENT AND TRADEMARK OFFICE

CERTIFICATE OF CORRECTION

PATENT NO. : 7,770,968 B2
APPLICATION NO. : 12/117254
DATED : August 10, 2010
INVENTOR(S) : Kerstin Bartlmae It is certified that error appears in the above-identified patent and that said Letters Patent is hereby corrected as shown below:

Column 2, line 29: After "18" delete "and.".

Column 2, line 62: After "28," insert --30--.

Signed and Sealed this

Nineteenth Day of October, 2010

David J. Kappos

David J. Kappos
*Director of the United States Patent and Trademark Office*